US005785408A

United States Patent [19]

Tseng

[11] Patent Number: 5,785,408

[45] Date of Patent: Jul. 28, 1998

[54] ILLUMINATING DEVICE FOR TOOL

[76] Inventor: Kuo Hwa Tseng, No. 355-1, Ruen Mei Road, Nan Mei Li, Changhwa, Taiwan

[21] Appl. No.: 844,508

[22] Filed: Apr. 18, 1997

[51] Int. Cl.[6] ..... B25B 23/18

[52] U.S. Cl. ..... 362/119; 362/120; 362/376

[58] Field of Search ..... 362/109, 119, 362/120, 190, 191, 208, 396; 7/165

[56] References Cited

U.S. PATENT DOCUMENTS 1,973,140 9/1934 Carlson ..... 362/109
5,124,893 6/1992 Jeng ..... 362/120
5,211,468 5/1993 Jeng ..... 362/119

*Primary Examiner*—Y my Quach
*Attorney, Agent, or Firm*—Charles E. Baxley, Esq.

[57] ABSTRACT

An illuminating device for a tool includes a light bulb secured in a housing and one or more batteries. The housing has a damper device for attaching to the tool. A switch is disposed between the battery and the light bulb and the housing has a blade for actuating the switch. The blade includes a projection for engaging with the tool and for allowing the blade to actuate the switch by the tool. The damper device has two openings for engaging with the tool and for allowing the tool to be disengaged from the projection when the tool is engaged in an outer opening.

4 Claims, 3 Drawing Sheets

ILLUMINATING DEVICE FOR TOOL

BACKGROUND OF THE INVENTION

1. Field of the Invention

The present invention relates to an illuminating device, and more particularly to an illuminating device for tools.

2. Description of the Prior Art

Typical tools, such as wrenches and screw drivers may be used during the night or in the dark. However, the workers have to carry another illuminating device with one hand for illuminating purposes, such that the workers may not easily operate the tools.

The present invention has arisen to mitigate and/or obviate the afore-described disadvantages of the conventional tools.

SUMMARY OF THE INVENTION

The primary objective of the present invention is to provide an illuminating device for engaging onto the tool and for allowing the working area to be illuminated.

In accordance with one aspect of the invention, there is provided an illuminating device for a tool comprising a housing, at least one light bulb secured in the housing, means for energizing the light bulb, and means for attaching the housing to the tool. At least one switch is disposed between the energizing means and the light bulb for being depressed to energize the light bulb. The housing includes an orifice, the actuating means includes a blade extended in the orifice for engaging with the switch, the blade includes a projection for engaging with the tool and for allowing the blade to actuate the switch when the projection is engaged with the tool.

The attaching means includes a pair of clampers extended from the housing and parallel with each other for clamping onto the tool.

The clampers include a first opening for engaging with tool and for allowing the projection to be disengaged from the tool and include a second opening for engaging with the tool and for allowing the projection to be actuated by the tool.

The clampers each includes a first depression for forming the first opening, and each includes a second depression for forming the second opening.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
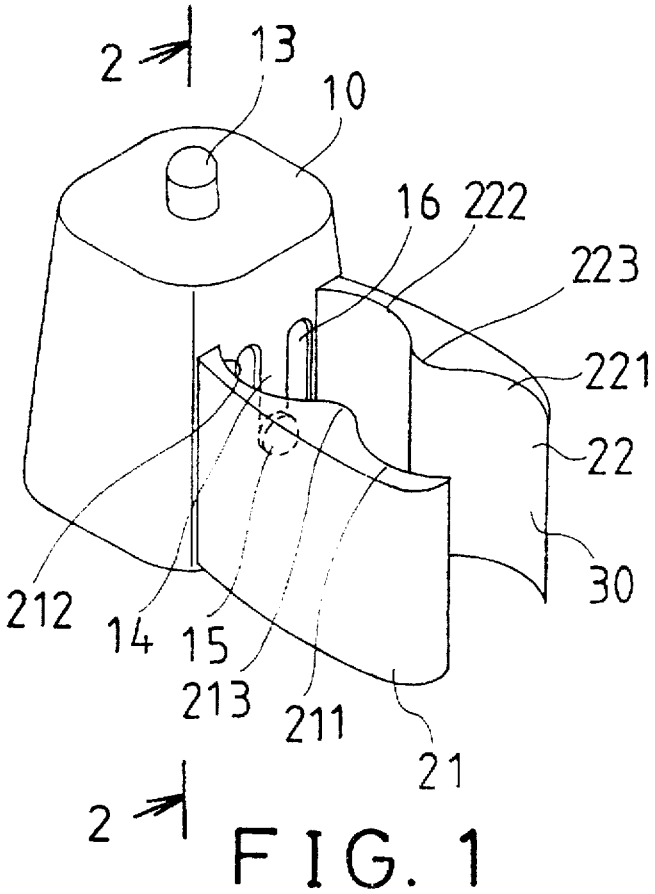
FIG. 1 is a perspective view of an illuminating device in accordance with the present invention.
Figure 2:
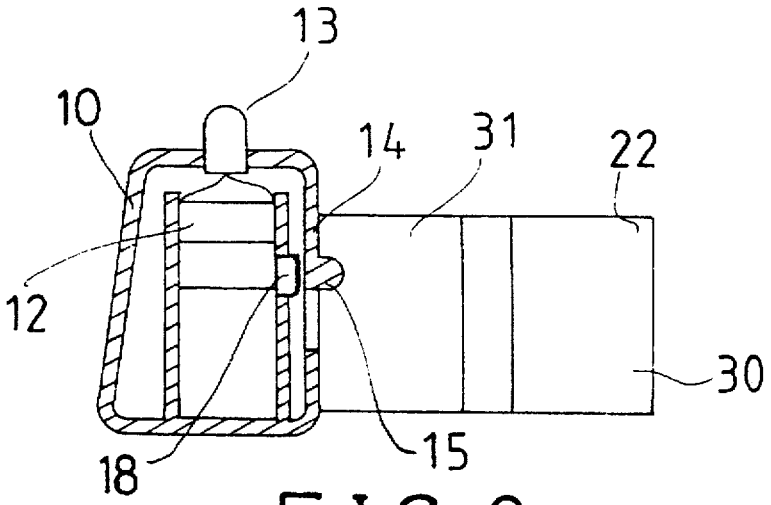
FIG. 2 is a cross sectional view taken along lines 2—2 of FIG. 1.
Figure 3:
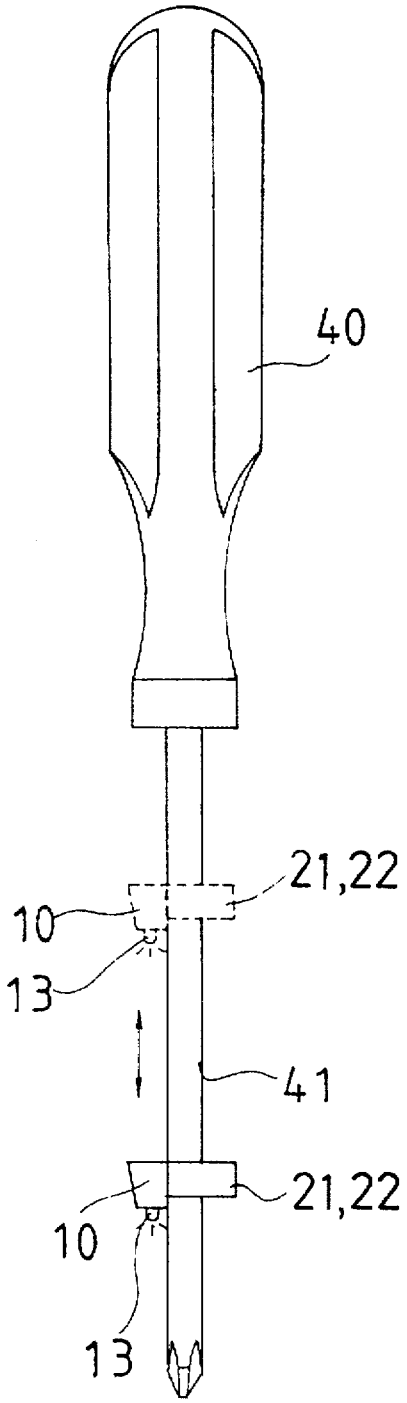
FIGS. 3 and 4 are plane views illustrating the operation of the illuminating device.

Referring to the drawings, and initially to FIGS. 1 and 2, an illuminating device in accordance with the present invention is provided for engaging onto the tool, such as wrench or screw driver. The illuminating device comprises a housing 10 and at least one light bulb 13 secured in the housing 10 and preferably extended outward of the housing. The light bulb 13 may also be engaged in the housing 10. One or more batteries 12 are secured in the housing 10. At least one switch 18 is electrically coupled between the light bulb 13 and the batteries 12 for allowing the switch 18 to control the electrical energy from the batteries 12 to the light bulb 13. The housing 10 includes an orifice 16 and a spring blade 14 extended in the orifice 16. The spring blade 14 includes a projection 15 provided on the free end portion. The housing 10 includes a pair of clampers 21, 22 extended outward and parallel to each other for engaging onto the driving stem 41 of the tools 40 (FIGS. 3 and 4).

As best shown in FIGS. 1 and 2, the clampers 21, 22 each includes two depressions 211, 212, 221, 222 for solidly engaging with the driving stem 41 and each includes a cusp 213, 223 formed between the depressions 211, 212, 221, 222 for allowing the driving stem 41 to be moved and engaged between the depressions. The depressions 211, 221 form an outer engaging opening 30 for disengaging the projection 15 from the driving stem 41, as shown in dotted lines in FIG. 4. The other depressions 212, 222 form an inner engaging opening 31 for allowing the driving stem 41 to depress the projection 15 and for allowing the spring blade 14 to actuate the switch 18 and the light bulb 13.

Figure 4:
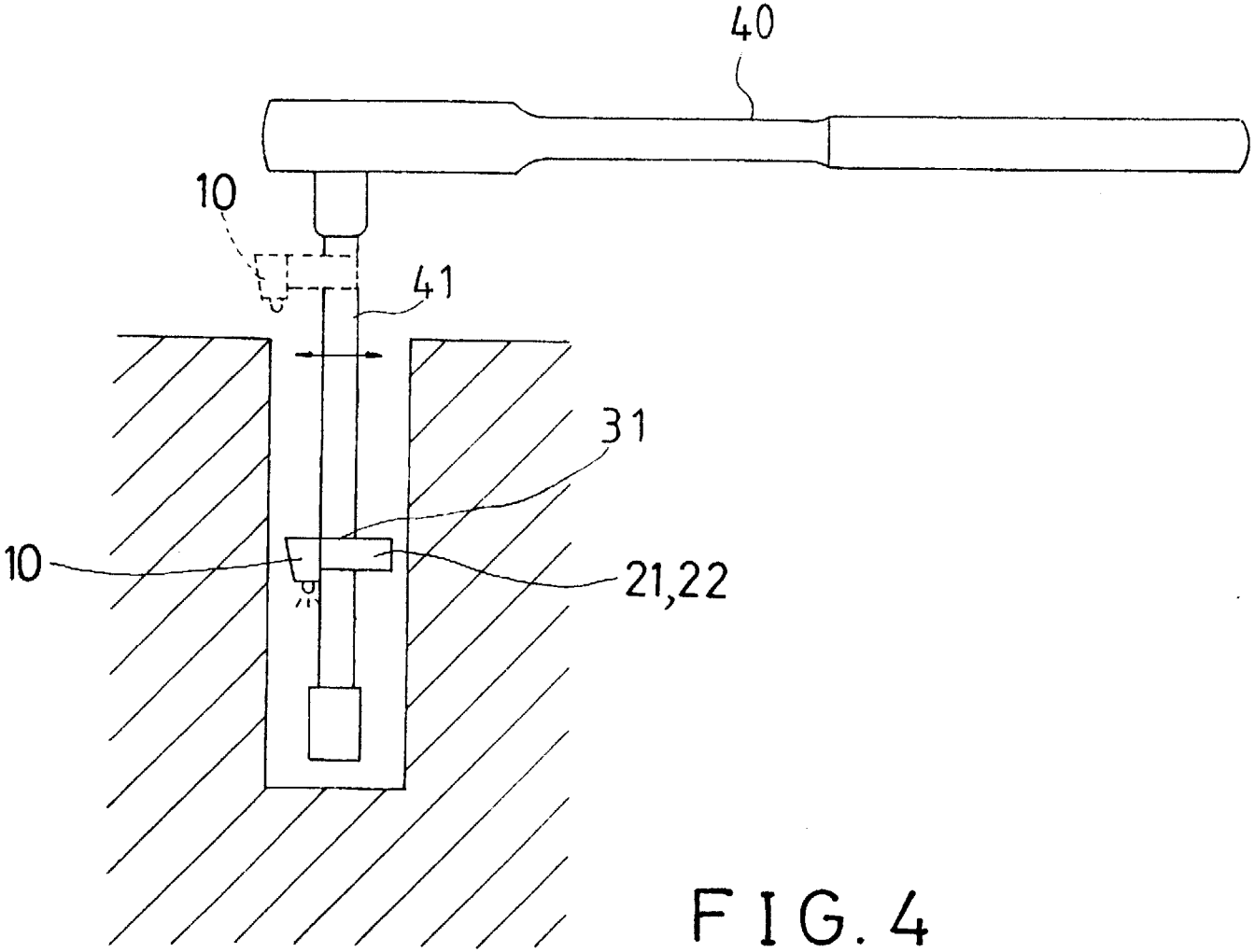

In operation, as shown in FIG. 4, the light bulb 13 may light the dark area for allowing the worker to clearly see the dark area. In addition, the worker does not need to hold the illuminating device such that the worker may easily operate the tool.

Accordingly, the illuminating device includes a light bulb for lighting the dark area and for allowing the worker to easily see the dark area.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An illuminating device for a tool comprising:

a housing including an orifice, at least one light bulb secured in said housing, means for energizing said light bulb, means for attaching said housing to the tool, at least one switch electrically coupled between said energizing means and said light bulb, and means for actuating said at least one switch, said actuating means including a blade extended in said orifice for engaging with said at least one switch, said blade including a projection for engaging with the tool and for allowing said blade to actuate said at least one switch when said projection is engaged with the tool.

2. An illuminating device according to claim 1, wherein said attaching means includes a pair of clampers extended from said housing and parallel with each other for clamping onto the tool.

3. An illuminating device according to claim 2, wherein said clampers include a first opening for engaging with the tool and for allowing said projection to be disengaged from the tool and include a second opening for engaging with the tool and for allowing said projection to be actuated by the tool.

4. An illuminating device according to claim 3, wherein said clampers each includes a first depression for forming said first opening, and said clampers each includes a second depression for forming said second opening.

* * * * *